US008937615B2

(12) United States Patent
Kim

(10) Patent No.: US 8,937,615 B2
(45) Date of Patent: Jan. 20, 2015

(54) PIXEL AND ORGANIC LIGHT EMITTING DISPLAY USING THE SAME

(75) Inventor: Dong-Hwi Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 681 days.

(21) Appl. No.: 12/854,050

(22) Filed: Aug. 10, 2010

(65) Prior Publication Data

US 2011/0102403 A1 May 5, 2011

(30) Foreign Application Priority Data

Nov. 3, 2009 (KR) ..... 10-2009-0105455

(51) Int. Cl.
*G09G 3/32* (2006.01)

(52) U.S. Cl.
CPC ..... *G09G 3/3233* (2013.01); *G09G 2320/045* (2013.01); *G09G 2300/043* (2013.01); *G09G 2300/0852* (2013.01); *G09G 2300/0861* (2013.01); *G09G 2310/0262* (2013.01); *G09G 2300/0819* (2013.01)
USPC ..... 345/211

(58) Field of Classification Search
CPC ..... G09G 3/3233; G09G 2320/045; G09G 2310/0262; G09G 2300/0852; G09G 2300/043
USPC ..... 345/211, 76; 313/504, 462
See application file for complete search history.

(56) References Cited

U.S. PATENT DOCUMENTS

2006/0022305 A1* 2/2006 Yamashita ..... 257/565
2006/0145964 A1* 7/2006 Park et al. ..... 345/76
2008/0111804 A1* 5/2008 Choi et al. ..... 345/205
2009/0027310 A1* 1/2009 Kim ..... 345/76
2009/0146987 A1* 6/2009 Kim et al. ..... 345/212

FOREIGN PATENT DOCUMENTS

KR 10-2008-0056923 A 6/2008
KR 10-2008-0091926 A 10/2008
KR 1020080091926 A 10/2008
KR 1020090020190 A 2/2009
KR 1020090059384 A 6/2009
KR 10-2009-0096893 A 9/2009

OTHER PUBLICATIONS

KIPO Office Action dated Jul. 29, 2011 for KR application No. 10-2009-0105455 (1 page).
Office action dated Apr. 20, 2011 for the corresponding Korean priority application No. 10-2009-0105455; 4 pages.

* cited by examiner

*Primary Examiner* — Ariel Balaoing
(74) *Attorney, Agent, or Firm* — Christie, Parker & Hale, LLP

(57) ABSTRACT

A pixel capable of compensating for the deterioration of an organic light emitting diode (OLED). The pixel includes an OLED coupled between first and second power sources, a pixel circuit including a driving transistor coupled between the first power source and the OLED and having a gate electrode coupled to a first node so that driving current corresponding to a voltage applied to the first node is supplied to the OLED, and a compensation circuit for controlling the voltage of the first node in accordance with deterioration of the OLED to compensate for the deterioration of the OLED. The compensation circuit includes first and second transistors coupled between the OLED and a third power source, first and second feedback capacitors coupled between the first node and a second node that is between the first transistor and the second transistor, and a third transistor coupled to the third power source.

22 Claims, 6 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2009-0105455, filed on Nov. 3, 2009, in the Korean Intellectual Property Office, the entire content of which is incorporated herein by reference.

BACKGROUND

1. Field

Aspects of embodiments of the present invention relate to a pixel and an organic light emitting display including the same.

2. Description of Related Art

Recently, various flat panel displays (FPDs) having reduced weight and volume as compared to cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light by re-combination of electrons and holes. The organic light emitting display has high response speed and is driven with low power consumption.

FIG. 1 is a circuit diagram illustrating a pixel of a conventional organic light emitting display.

Referring to FIG. 1, a pixel 4 of the conventional organic light emitting display includes an organic light emitting diode OLED and a pixel circuit 2 coupled to a data line Dm and a scan line Sn to control the OLED. An anode electrode of the OLED is coupled to the pixel circuit 2 and a cathode electrode of the OLED is coupled to a second power source ELVSS. The OLED emits light with a brightness corresponding to a current supplied from the pixel circuit 2.

The pixel circuit 2 controls the amount of current supplied to the OLED in accordance with a data signal supplied to the data line Dm when a scan signal is supplied to the scan line Sn. Therefore, the pixel circuit 2 includes a driving transistor MD coupled between a first power source ELVDD and the OLED, a switching transistor MS coupled between a gate electrode of the driving transistor MD and the data line Dm, and a storage capacitor Cst coupled between the gate electrode of the driving transistor MD and a source electrode of the driving transistor MD.

The switching transistor MS is coupled between the data line Dm and one electrode (terminal) of the storage capacitor Cst. A gate electrode of the switching transistor MS is coupled to the scan line Sn. The switching transistor MS is turned on when the scan signal (for example, at a low level) is supplied from the scan line Sn to supply the data signal supplied from the data line Dm to the storage capacitor Cst. At this time, a voltage corresponding to the data signal is charged in the storage capacitor Cst.

The driving transistor MD is coupled between the first power source ELVDD and the OLED. The gate electrode of the driving transistor MD is coupled to one electrode of the storage capacitor Cst. The driving transistor MD controls the driving current that flows from the first power source ELVDD to the second power source ELVSS via the OLED in accordance with the voltage value stored in the storage capacitor Cst. The OLED generates light with the brightness corresponding to a magnitude of the driving current.

The above-described conventional pixel may not display an image with desired brightness due to an efficiency change caused by deterioration of the OLED. As the OLED deteriorates, light with low brightness is generated.

SUMMARY

Accordingly, embodiments of the present invention provide for a pixel capable of compensating for the deterioration of an organic light emitting diode (OLED) and an organic light emitting display including the same.

According to an embodiment of the present invention, a pixel is provided. The pixel includes an organic light emitting diode (OLED), a pixel circuit, and a compensation circuit. The OLED is coupled between a first power source and a second power source. The pixel circuit includes a driving transistor coupled between the first power source and the OLED. The driving transistor has a gate electrode coupled to a first node so that driving current corresponding to a voltage applied to the first node is supplied to the OLED. The compensation circuit is for controlling the voltage of the first node in accordance with deterioration of the OLED to compensate for the deterioration of the OLED. The compensation circuit includes first, second, and third transistors along with first and second feedback capacitors. The first and second transistors are coupled between the OLED and a third power source. The first and second feedback capacitors are coupled between the first node and a second node. The second node is between the first transistor and the second transistor. The third transistor is coupled between the third power source and a third node. The third node is between the first feedback capacitor and the second feedback capacitor.

The pixel circuit may further include a first capacitor, a switching transistor, and fourth, fifth, and sixth transistors. The first capacitor has one terminal coupled to the first node and an other terminal coupled to a fourth node. The switching transistor is coupled between the fourth node and a data line. The fourth transistor is coupled between the gate electrode of the driving transistor and a drain electrode of the driving transistor. The fifth transistor is coupled between the fourth node and the third power source. The sixth transistor is coupled between the driving transistor and the OLED.

The pixel circuit may be coupled between the first node and the first power source.

A gate electrode of the switching transistor and a gate electrode of the fourth transistor may be coupled to a first scan line to receive a first scan signal from the first scan line. A gate electrode of the fifth transistor may be coupled to a first emission control line to receive a first emission control signal from the first emission control line. A gate electrode of the sixth transistor may be coupled to a second emission control line to receive a second emission control signal from the second emission control line.

The first emission control signal and the second emission control signal may be voltages of a first voltage level that turn off the fifth and sixth transistors and that are sequentially shifted by a first horizontal period width. The first scan signal may be supplied as a voltage of a second voltage level that is lower than the first voltage level and that turns on the switching transistor and the fourth transistor while the first emission control signal maintains the first voltage level so that the first scan signal starts before the second emission control signal transitions to the first voltage level and stops after the second emission control signal transitions to the first voltage level.

The first and second emission control signals may maintain the first voltage level for a second horizontal period width.

The first scan signal may maintain the second voltage level for a part of the first horizontal period width.

A gate electrode of the first transistor may be coupled to a second scan line to receive a second scan signal from the second scan line that is shifted from the first scan signal by the second horizontal period width. A gate electrode of the second transistor may be coupled to a third emission control line to receive a third emission control signal that is a voltage of the first voltage level from the third emission control line and that is shifted from the second emission control signal by the first horizontal period width. A gate electrode of the third transistor may be coupled to a third scan line to receive a third scan signal that is a voltage of the second voltage level, that transitions to the second voltage level to turn on the third transistor before the third emission control signal transitions to the first voltage level, and transitions to the first voltage level after the second scan signal is supplied from the second scan line.

The pixel circuit may further include a seventh transistor coupled between the first node and a fourth power source.

A gate electrode of the switching transistor may be coupled to a first scan line to receive a first scan signal from the first scan line. A gate electrode of the fourth transistor and a gate electrode of the fifth transistor may be coupled to a fourth scan line to receive a fourth scan signal from the fourth scan line. A gate electrode of the sixth transistor and a gate electrode of the seventh transistor may be coupled to a second emission control line and a fifth scan line to receive a second emission control signal and a fifth scan signal from the second emission control line and the fifth scan line.

The fifth, fourth, and first scan signals may be sequentially shifted by a first horizontal period width. The second emission control signal may overlap the fifth and fourth scan signals.

A gate electrode of the first transistor may be coupled to the first scan line to receive the first scan signal from the first scan line. A gate electrode of the second transistor may be coupled to a fourth emission control line to receive a fourth emission control signal from the fourth emission control line that is shifted from the second emission control signal by a second horizontal period width. A gate electrode of the third transistor may be coupled to a fifth emission control line to receive a fifth emission control signal from the fifth emission control line that is shifted from the second emission control signal by a third horizontal period width.

The fifth, fourth, and first scan signals may be voltages of a second voltage level that turn on transistors. The second, fourth, and fifth emission control signals may be voltages of a first voltage level that is higher than the second voltage level and that turn off transistors.

The fourth power source may be set as an initialization power source.

The first power source and the second power source may be set as a high potential pixel power source and a low potential pixel power source to form a current path in a period where the driving current is supplied to the OLED. The third power source may be set as a constant voltage source that does not form a current path.

The voltage of the third power source may have a value between a voltage of the first power source and a voltage of the second power source.

According to another embodiment of the present invention, an organic light emitting display is provided. The organic light emitting display includes a display unit. The display unit includes a plurality of pixels located at crossing regions of scan lines, emission control lines, and data lines. Each of the pixels includes an organic light emitting diode (OLED), a pixel circuit, and a compensation circuit. The OLED is coupled between a first power source and a second power source. The pixel circuit includes a driving transistor. The driving transistor is coupled between the first power source and the OLED. The driving transistor has a gate electrode coupled to a first node so that driving current corresponding to a voltage applied to the first node is supplied to the OLED. The compensation circuit is for controlling the voltage of the first node in accordance with deterioration of the OLED to compensate for the deterioration of the OLED. The compensation circuit includes first, second, and third transistors along with first and second feedback capacitors. The first and second transistors are coupled between the OLED and a third power source. The first and second feedback capacitors are coupled between the first node and a second node. The second node between the first transistor and the second transistor. The third transistor is coupled between the third power source and a third node. The third node is between the first feedback capacitor and the second feedback capacitor.

The pixel circuit may further include a first capacitor, a switching transistor, and fourth, fifth, and sixth transistors. The first capacitor has one terminal coupled to the first node and an other terminal coupled to a fourth node. The switching transistor is coupled between the fourth node and a data line. The switching transistor has a gate electrode coupled to a first scan line to receive a first scan signal. The fourth transistor is coupled between the gate electrode of the driving transistor and a drain electrode of the driving transistor. The fourth transistor has a gate electrode coupled to the first scan line. The fifth transistor is coupled between the fourth node and the third power source. The fifth transistor has a gate electrode coupled to a first emission control line to receive a first emission control signal. The sixth transistor is coupled between the driving transistor and the OLED. The sixth transistor has a gate electrode coupled to a second emission control line to receive a second emission control signal.

A gate electrode of the first transistor may be coupled to a second scan line to receive a second scan signal. A gate electrode of the second transistor may be coupled to a third emission control line to receive a third emission control signal. A gate electrode of the third transistor may be coupled to a third scan line to receive a third scan signal.

The first to third emission control signals may be voltages of a first voltage level sequentially shifted by a first horizontal period width. The first scan signal may be supplied as a voltage of a second voltage level that is lower than the first voltage level while the first emission control signal maintains the first voltage level so that the first scan signal starts before the second emission control signal transitions to the first voltage level and stops after the second emission control signal transitions to the second voltage level. The second scan signal may be shifted from the first scan signal by a second horizontal period width. The third scan signal may be a voltage of the second voltage level that transitions to the second voltage level before the third emission control signal transitions to the first voltage level, and transitions to the first voltage level after the second scan signal is supplied.

The pixel circuit may further include a first capacitor, a switching transistor, and fourth, fifth, sixth, and seventh transistors. The first capacitor has one terminal coupled to the first node and an other terminal coupled to a fourth node. The switching transistor is coupled between the fourth node and a data line. The switching transistor has a gate electrode coupled to a first scan line to receive a first scan signal. The fourth transistor is coupled between the gate electrode of the driving transistor and a drain electrode of the driving transistor. The fourth transistor has a gate electrode coupled to a fourth scan line to receive a fourth scan signal. The fifth transistor is coupled between the fourth node and the third power source. The fifth transistor has a gate electrode coupled to the fourth scan line. The sixth transistor is coupled between the driving transistor and the OLED. The sixth transistor has a gate electrode coupled to a second emission control line to receive a second emission control signal. The seventh transistor is coupled between the first node and a fourth power source. The seventh transistor has a gate electrode coupled to a fifth scan line to receive a fifth scan signal.

A gate electrode of the first transistor may be coupled to the first scan line. A gate electrode of the second transistor may be coupled to a fourth emission control line to receive a fourth emission control signal. A gate electrode of the third transistor may be coupled to a fifth emission control line to receive a fifth emission control signal.

The fifth, fourth, and first scan signals may be sequentially shifted by a first horizontal period width. The second emission control signal may overlap the fifth and fourth scan signals. The fourth and fifth emission control signals may be shifted from the second emission control signal by a second horizontal period width and a third horizontal period width.

According to embodiments of the present invention, the voltage of the gate electrode of the driving transistor is controlled to correspond to the deterioration of the OLED so that the deterioration of the OLED may be compensated for.

BRIEF DESCRIPTION OF THE DRAWINGS

The accompanying drawings, together with the specification, illustrate exemplary embodiments of the present invention, and, together with the description, serve to explain principles of the present invention.

DETAILED DESCRIPTION

Figure 1:
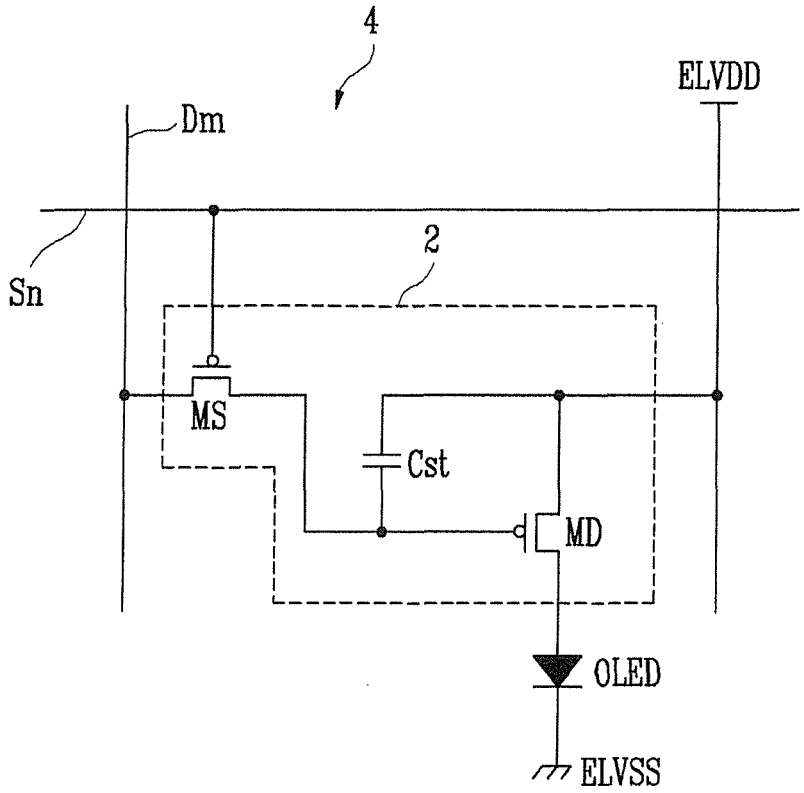
FIG. 1 (PRIOR ART)
FIG. 1 is a pixel diagram illustrating the pixel of a conventional organic light emitting display.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the invention are omitted for clarity. In addition, like reference numerals refer to like elements throughout.

Figure 2:
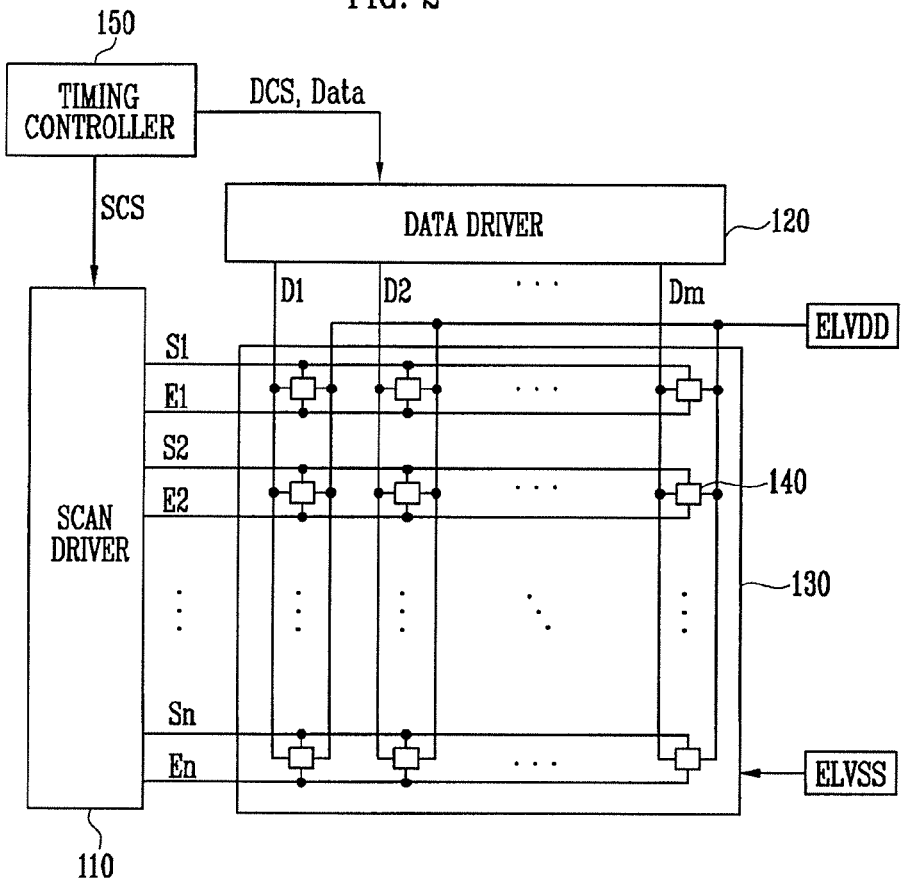
FIG. 2 is a block diagram schematically illustrating an organic light emitting display according to an embodiment of the present invention.

FIG. 2 is a block diagram schematically illustrating an organic light emitting display according to an embodiment of the present invention.

Referring to FIG. 2, the organic light emitting display includes a display unit 130 including a plurality of pixels 140 located (positioned) at crossing regions of scan lines S1 to Sn, emission control lines E1 to En, and data lines D1 to Dm; a scan driver 110 for supplying scan signals and emission control signals to the scan lines S1 to Sn and the emission control lines E1 to En, respectively; a data driver 120 for supplying data signals to the data lines D1 to Dm; and a timing controller 150 for controlling the scan driver 110 and the data driver 120.

The pixels 140 included in the display unit 130 receive the scan signals and the data signals from the scan driver 110 and the data driver 120, respectively. In addition, first power source ELVDD and second power source ELVSS are coupled to the display unit 130 from the outside such as a power source supply unit (not shown) and a first power from the first power source ELVDD and a second power from the second power source ELVSS are transmitted to the pixels 130. Here, the first power source ELVDD and the second power source ELVSS may represent a high potential pixel power source and a low potential pixel power source, respectively. In addition, although not shown, the display unit 130 may additionally receive a compensation power from a compensation power source in accordance with the structure of the pixels 140.

The pixels 140 store the data signals supplied when the scan signals are applied and emit light with brightness corresponding to driving currents that flow from the first power source ELVDD to the second power source ELVSS via organic light emitting diodes (OLEDs, shown in FIG. 3, for example) in accordance with the data signals. That is, the first power source ELVDD and the second power source ELVSS form a current path while the driving currents are supplied to the OLEDs.

The scan driver 110 receives scan driving control signals SCS from the timing controller 150 and generates the scan signals and the emission control signals in accordance with the scan driving control signals SCS. The scan driver 110 supplies the generated scan signals and emission control signals to the scan lines S1 to Sn and the emission control lines E1 to En, respectively.

While in FIG. 2, it is illustrated that the scan signals and the emission control signals are generated by the scan driver 110, the present invention is not limited thereto. For example, the emission control signals may be generated by a separate emission control driver.

The data driver 120 receives data driving control signals DCS and data Data from the timing controller 150 and generates the data signals in accordance with the data driving control signals DCS and the data Data. The data driver 120 supplies the generated data signals to the data lines D1 to Dm.

The timing controller 150 generates the data driving control signals DCS and the scan driving control signals SCS in accordance with synchronizing signals supplied from the outside. The data driving control signals DCS generated by the timing controller 150 are supplied to the data driver 120 and the scan driving control signals SCS are supplied to the scan driver 110. In addition, the timing controller 150 supplies the data Data supplied from the outside to the data driver 120.

According to an embodiment of the present invention, each of the pixels 140 includes a pixel circuit for compensating for threshold voltage variation of a driving transistor (not shown) and voltage reduction variation of the first power from the first power source ELVDD, and a compensation circuit for compensating for a deterioration of the OLED.

The pixels 140 are coupled to the plurality of scan lines and emission control lines. The number and type of the scan lines and the emission control lines to which the pixels 140 are coupled may vary in accordance with an internal structure of the pixels 140. For the sake of conciseness, in FIG. 2, the pixels 140 will not be described in detail. Exemplary pixels will be disclosed through the following embodiments.

Figure 3:
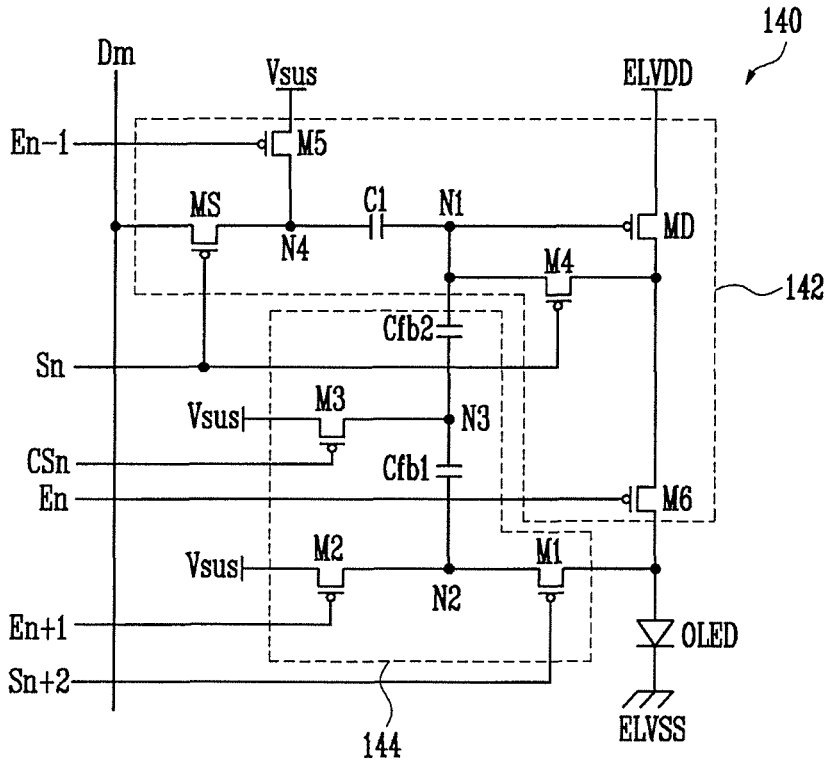
FIG. 3 is a circuit diagram illustrating the pixel of the organic light emitting display of FIG. 2.

FIG. 3 is a circuit diagram illustrating the pixel of the organic light emitting display of FIG. 2. For ease of explanation, in FIG. 3, the pixel located in an nth horizontal line will be described.

Referring to FIG. 3, the pixel 140 includes an OLED, a pixel circuit 142 for supplying driving current corresponding to a data signal to the OLED, and a compensation circuit 144 for compensating for the deterioration of the OLED.

More specifically, the OLED is coupled between the first power source ELVDD and the second power source ELVSS. The OLED emits light with brightness corresponding to the driving current supplied from the pixel circuit 142.

The pixel circuit 142 includes a driving transistor MD, a switching transistor MS, a first capacitor C1, and fourth to sixth transistors M4, M5, and M6. The driving transistor MD is coupled between the first power source ELVDD and the OLED. A gate electrode of the driving transistor MD is coupled to a first node N1. The driving transistor MD supplies the driving current in accordance with a voltage of the first node N1 to the OLED. Because the voltage corresponding to the data signal is applied to the first node N1 in a period when the driving transistor MD supplies the driving current to the OLED, the driving transistor MD supplies the driving current corresponding to the data signal to the OLED.

The switching transistor MS is coupled between a data line Dm and a fourth node N4. A gate electrode of the switching transistor MS is coupled to a first scan line Sn. Here, the first scan line Sn is a current scan line in a row where the corresponding pixel 140 receives a scan signal that turns on the switching transistor MS in a period where the data signal is stored in the pixel. That is, the switching transistor MS supplies the data signal from the data line Dm to the inside of the pixel (the fourth node N4) in response to the scan signal (a first scan signal) from the first scan line Sn.

The first capacitor C1 is coupled between the first node N1 and the fourth node N4. The first capacitor C1 charges a voltage corresponding to a threshold voltage of the driving transistor MD together with the data signal in a data programming period where the data signal is stored in the pixel.

The fourth transistor M4 is coupled between the gate electrode of the driving transistor MD and a drain electrode of the driving transistor MD. A gate electrode of the fourth transistor M4 is coupled to the first scan line Sn. The fourth transistor M4 diode couples the driving transistor MD in response to the first scan signal supplied from the first scan line Sn.

The fifth transistor M5 is coupled between a third power source Vsus and the fourth node N4. A gate electrode of the fifth transistor M5 is coupled to a first emission control line En−1.

The first emission control line En−1 receives a previous emission control signal (a first emission control signal) that precedes a second emission control signal supplied to a second emission control line En, which is a current emission control line in the row where the corresponding pixel 140 is located, by a first horizontal period width 1H. In further detail, the first and second emission control lines En−1 and En receive the sequentially shifted and supplied first and second emission control signals and the first and second emission control signals are set to have a width of about a second horizontal period width 2H (for example, the second horizontal period width 2H has twice the value of the first horizontal period width 1H) and are supplied so that pulses overlap by the first horizontal period width 1H.

The fifth transistor M5 couples the fourth node N4 to the third power source Vsus in response to the first emission control signal supplied from the first emission control line En−1.

Unlike the first and second power sources ELVDD and ELVSS, the third power source Vsus is a constant voltage source that does not form a current path. The voltage value of the third power source Vsus may be set as a value between a voltage value of the first power source ELVDD and a voltage value of the second power source ELVSS. For example, the voltage value of the third power source Vsus may be set as a voltage value of a data signal corresponding to black.

The sixth transistor M6 is coupled between the driving transistor MD and the OLED. A gate electrode of the sixth transistor M6 is coupled to the second emission control line En. The sixth transistor M6 transmits or blocks the driving current generated by the driving transistor MD to the OLED in response to the second emission control signal supplied from the second emission control line En. The second emission control signal transitions from a low level to a high level while the current scan signal is supplied, and maintains the high level in a period of about the second horizontal period width 2H.

The compensation circuit 144 controls the voltage of the gate electrode of the driving transistor MD to correspond to the deterioration of the OLED and to compensate for the deterioration of the OLED. That is, the compensation circuit 144 controls the voltage of the first node N1 to be reduced as the OLED deteriorates to compensate for the deterioration of the OLED.

The compensation circuit 144 includes a first transistor M1 and a second transistor M2 coupled between the OLED and the third power source Vsus, a first feedback capacitor Cfb1 and a second feedback capacitor Cfb2 coupled between the first node N1 and a second node N2, which is a coupling node of (for example, between) the first and second transistors M1 and M2, and a third transistor M3 coupled between the third power source Vsus and a third node N3, which is a coupling node of the first and second feedback capacitors Cfb1 and Cfb2.

In detail, the first transistor M1 is coupled between an anode electrode of the OLED and the second node N2 and a gate electrode of the first transistor M1 is coupled to a second scan line Sn+2. Here, the second scan line Sn+2 receives a second scan signal delayed by the second horizontal period width 2H in comparison with the first scan signal. That is, the second scan signal is a current scan signal of a current scan line Sn+2 of a pixel in an (n+2)th (n is a natural number) row. In other words, the first transistor M1 couples the anode electrode of the OLED to the second node N2 in response to the second scan signal, which is shifted (delayed) by the second horizontal period width 2H in comparison with the first scan signal.

The second transistor M2 is coupled between the second node N2 and the third power source Vsus. A gate electrode of the second transistor M2 is coupled to a third emission control line En+1. Here, the third emission control line En+1 receives the third emission control signal shifted by the first horizontal period width 1H in comparison with the second emission control signal. That is, the third emission control line is a current emission control line of a pixel in a next row. In other words, the second transistor M2 couples the second node N2 to the third power source Vsus in response to the third emission control signal, which is shifted by the first horizontal period width 1H in comparison with the second emission control signal.

The first feedback capacitor Cfb1 is coupled between the second node N2 and the third node N3. The first feedback capacitor Cfb1 changes the voltage of the third node N3 in response to the voltage change of the second node N2.

The second feedback capacitor Cfb2 is coupled between the third node N3 and the first node N1. The second feedback capacitor Cfb2 changes the voltage of the first node N1 in response to the voltage change of the third node N3.

The third transistor M3 is coupled between the third node N3 and the third power source Vsus. A gate electrode of the third transistor M3 is coupled to a third scan line CSn. Here, the third scan line CSn transmits a third scan signal that has a larger width than the first and second scan signals. The third scan signal starts after the first scan signal is supplied and stops after the second scan signal is supplied. In particular, the third scan signal transitions to a low level before the third emission control signal transitions to a high level and transitions to a high level after the second scan signal transitions to a high level. Thus, the third transistor M3 couples the third node N3 to the third power source Vsus in response to the third scan signal.

The above-described pixel 140 supplies the driving current corresponding to the data signal to the OLED, regardless of variation in the threshold voltage of the driving transistor MD and variation in the voltage reduction of the first power source ELVDD using the pixel circuit 142, to improve picture quality. In addition, the pixel 140 controls the voltage of the gate electrode of the driving transistor MD to correspond to the deterioration of the OLED using the compensation circuit 144 to compensate for the deterioration of the OLED. Therefore, image sticking may be reduced or prevented.

Figure 4:
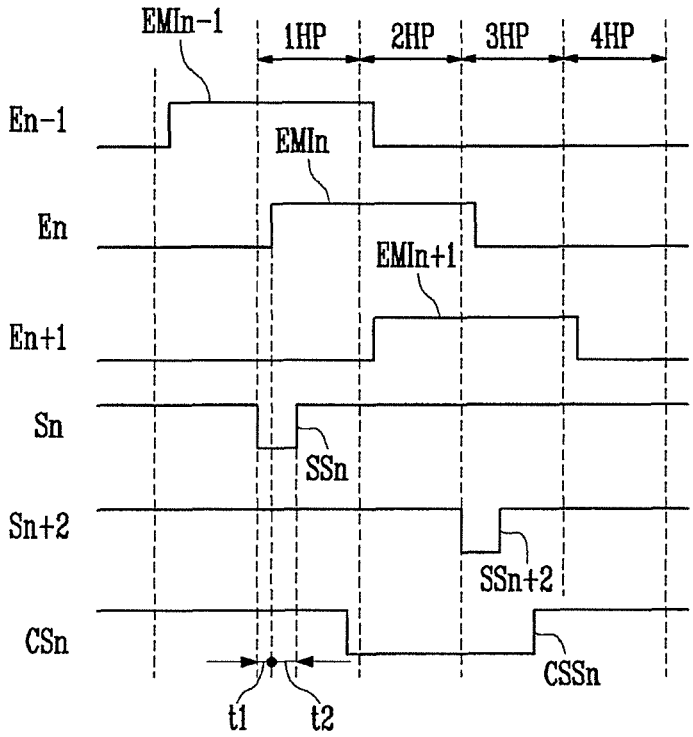
FIG. 4 is a waveform diagram illustrating a method of driving the pixel of FIG. 3.

FIG. 4 is a waveform diagram illustrating a method of driving the pixel of FIG. 3. For the sake of illustration, in FIG. 4, first, second, and third scan signals SSn, SSn+2, and CSSn are supplied in a low level and first, second, and third emission control signals EMIn−1, EMIn, and EMIn+1 are supplied in a high level.

Referring to FIG. 4, the first and second scan signals SSn and SSn+2 are sequentially supplied in first and third horizontal periods 1HP and 3HP. Here, the first and second scan signals SSn and SSn+2 are supplied in a portion of the first and third horizontal periods 1 HP and 3HP, respectively, and sequentially shifted by the second horizontal period width 2H.

In addition, the first to third emission control signals EMIn−1, EMIn, and EMIn+1 each have a width of the second horizontal period width 2H and are sequentially shifted by the first horizontal period width 1H. The second emission control signal EMIn that is the current emission control signal transitions to a high level during the portion of the first horizontal period 1 HP when the first scan signal SSn is supplied in a low level and maintains this high level throughout a second horizontal period 2HP.

The third scan signal CSSn starts before the first emission control signal EMIn−1 transitions to a low level and before the third emission control signal EMIn+1 transitions to a high level, and stops after the second scan signal SSn+2 is supplied.

Hereinafter, the operation processes of the pixel 140 illustrated in FIG. 3 will be described in detail with reference to FIG. 4 in combination with FIG. 3.

First, the first scan signal SSn is supplied to the first scan line Sn in at least a portion of the first horizontal period 1HP. The second emission control signal EMIn supplied from the second emission control line En transitions from a low level to a high level at an initial stage of the portion of the first horizontal period 1 HP in which the first scan signal SSn is supplied. During the portion where the first scan signal SSn is supplied, the second and third scan signals SSn+2 and CSSn from the second and third scan lines Sn+2 and CSn, respectively, and the first emission control signal EMIn−1 from the first emission control line En−1 maintain a high level while the third emission control signal EMIn+1 from the third emission control line En+1 maintains a low level.

In a period t1 where the first scan signal SSn and the second emission control signal EMIn are set to a low level, the switching transistor MS and the fourth and sixth transistors M4 and M6 are turned on. Therefore, the voltage stored in the first capacitor C1 in a previous frame period is initialized through the fourth and sixth transistors M4 and M6. That is, the period t1 is set as the initialization period of the pixel 140.

The period t1 would be appreciated by one skilled in the art without undue experimentation. For example, the period t1 may be determined to be maintained for a sufficient time such that the pixel 140 is initialized. During the period t1, the fourth node N4 receives a voltage Vdata of the data signal by the switching transistor MS and the second node N2 maintains a voltage Vsus of the third power source Vsus by the second transistor M2.

When the period t1 is terminated, the second emission control signal EMIn starts so that the voltage level of the second emission control signal EMIn transitions to a high level while the first scan signal SSn maintains a low level in a following period t2. In the period t2, the sixth transistor M6 is turned off while the switching transistor MS and the fourth transistor M4 remain turned on.

In the period t2, the voltage Vdata of the data signal is applied to the fourth node N4 by the switching transistor MS. In addition, the driving transistor MD is diode coupled by the fourth transistor M4, so a voltage ELVDD−|Vth| corresponding to a difference between the voltage of the first power source ELVDD and a threshold voltage Vth of the driving transistor MD is applied to the first node N1. Then, a voltage ELVDD−|Vth|−Vdata corresponding to a difference between the voltage of the first node N1 and the voltage of the fourth node N4 is stored in the first capacitor C1.

In the second horizontal period 2HP that follows the first horizontal period 1 HP, the third scan signal CSSn is supplied and the first and second scan signals SSn and SSn+2 and the second emission control signal EMIn maintain a high level. Then, the first emission control signal EMIn−1 transitions to a low level while the third emission control signal EMIn+1 transitions to a high level. When the third emission control signal EMIn+1 transitions to a high level, the second transistor M2 is turned off and the second node N2 is floated.

The third scan signal CSSn starts being supplied before the first emission control signal EMIn−1 transitions to a low level and before the third emission control signal EMIn+1 transitions to a high level. As a result, the voltage Vsus of the third power source Vsus is supplied to the third node N3 and that the voltage of the third node N3 may be uniformly maintained.

As the first emission control signal EMIn−1 transitions to a low level, the fifth transistor M5 is turned on so that the voltage of the fourth node N4 is changed from the voltage Vdata of the data to the voltage Vsus of the third power source Vsus. At this time, the voltage of the first node N1 changes by a voltage difference between the voltage Vdata of the data signal and the voltage Vsus of the third power source Vsus, that is, j(Vsus−Vdata) corresponding to Vdata−Vsus. Here, j is a proportionate value corresponding to charge sharing by a capacitance ratio between the first capacitor C1 and the second feedback capacitor Cfb2. Therefore, the voltage of the first node N1 is ELVDD−|Vth|+j(Vsus−Vdata).

In a portion (an initial portion) of the third horizontal period 3HP that follows the second horizontal period 2HP, the second scan signal SSn+2 is supplied. In the portion when the second scan signal SSn+2 is supplied, the third scan signal CSSn maintains a low level.

In addition, the voltage width of the second emission control signal EMIn in a high level is set to the second horizontal period width 2H, and the second emission control signal EMIn maintains the high level throughout the second horizontal period 2HP. The second emission control signal EMIn transitions to a low level at an initial stage of the portion of the third horizontal period 3HP when the second scan signal SSn+2 is supplied.

When the second emission control signal EMIn transitions to a low level in the third horizontal period 3HP, the sixth transistor M6 is turned on. Therefore, the first power source ELVDD, the driving transistor MD, the sixth transistor M6, and the OLED are electrically coupled to each other.

At this time, the driving transistor MD supplies current Ioled illustrated in the following EQUATION 1 to the OLED to correspond to a voltage difference between the gate electrode of the driving transistor MD and a source electrode of the driving transistor MD.

$$Ioled=k(Vgs-|Vth|)^2=k(ELVDD-(ELVDD-|Vth|+j(Vsus-V\text{data}))-|Vth|)^2=k(j(Vsus-V\text{data}))^2 \quad \text{EQUATION 1}$$

The third power source Vsus does not form a current path, so there is no voltage reduction in the line that couples to the third power source Vsus. Therefore, the same voltage Vsus may be supplied to all of the pixels. In addition, since the threshold voltage Vth of the driving transistor MD is erased, the current Ioled that flows through the OLED is determined independently of the threshold voltage Vth of the driving transistor MD.

That is, in the pixel 140 according to an embodiment of the present invention, the voltage Vdata of the data signal controls the desired driving current Ioled flowing through the OLED regardless of the voltage reduction variation of the first power source ELVDD and the threshold voltage variation of the driving transistor MD.

While the second scan signal SSn+2 and the third scan signal CSSn are continuously in a low level, the second node N2 receives a voltage Voled applied to the OLED through the first transistor M1 and the third node N3 maintains the voltage Vsus of the third power source Vsus by the third transistor M3. Therefore, a voltage corresponding to the voltage Voled applied to the OLED is charged in the first feedback capacitor Cfb1.

Then, later in the third horizontal period 3HP, when the second scan signal SSn+2 and the third scan signal CSSn stop being supplied (that is, when the second scan signal SSn+2 and the third scan signal CSSn transition to a high level), the first and third transistors M1 and M3 are turned off and the second and third nodes N2 and N3 are floated.

In a fourth horizontal period 4HP that follows the third horizontal period 3HP, when the voltage level of the third emission control signal EMIn+1 transitions to a low level, the second transistor M2 is turned on. Therefore, the voltage of the second node N2 increases from the voltage Voled of the OLED to the voltage of the third power source Vsus. At this time, since the third node N3 is floated, the voltage of the third node N3 rises to correspond to the voltage increase of the second node N2. Since the first node N1 is floated, the voltage of the first node N1 increases (for example, to a predetermined degree) to correspond to the voltage increase of the third node N3.

That is, in the fourth horizontal period 4HP, the voltage of the first node N1 is controlled to correspond to the voltage increase of the second node N2 and the driving transistor MD supplies the driving current corresponding to the changed voltage of the first node N1 to the OLED.

With time, the OLED deteriorates so that the voltage Voled applied to the OLED increases. That is, when the driving current is supplied to the OLED, the voltage Voled applied to the OLED increases as the OLED deteriorates. As the OLED deteriorates, the voltage increase of the second node N2 is reduced so that the voltage increase of the first node N1 is reduced. Then, the driving current supplied from the driving transistor MD to the OLED increases to correspond to the same data signal. Therefore, the brightness deterioration in accordance with the deterioration of the OLED may be compensated for.

As described above, the brightness deterioration in accordance with the deterioration of the OLED may be compensated for. Thus, aging for preventing the rapid brightness deterioration at the initial stage of production may be omitted so that production efficiency may be increased and the life of a panel may be increased.

Figure 5:
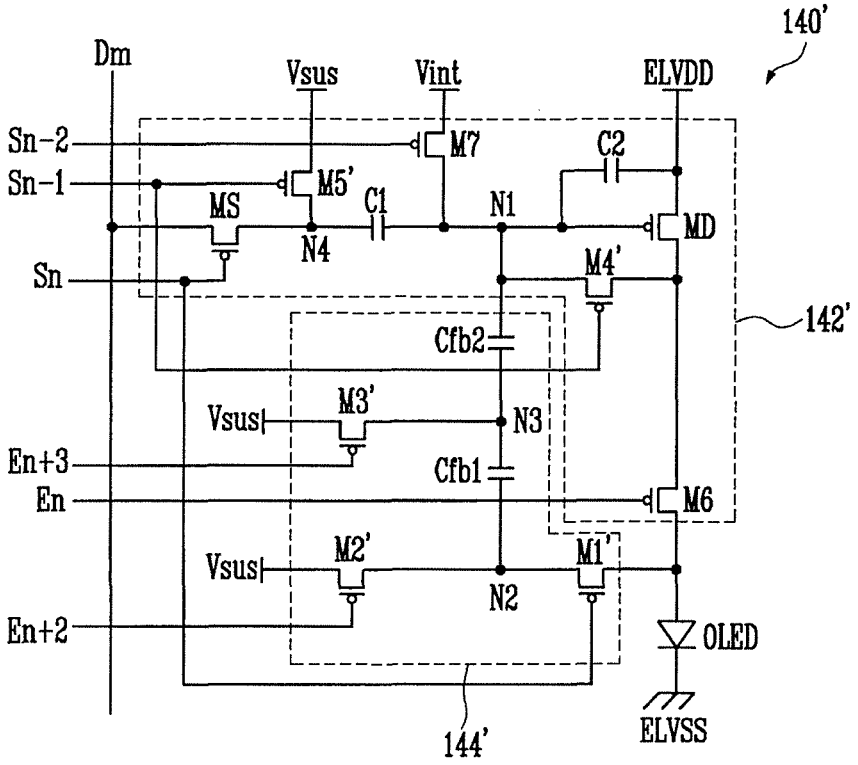
FIG. 5 is a circuit diagram illustrating the pixel of an organic light emitting display according to another embodiment of the present invention.

FIG. 5 is a circuit diagram illustrating the pixel of an organic light emitting display according to another embodiment of the present invention. For ease of explanation, in FIG. 5, description of the same elements as the elements of FIG. 3 will be omitted.

First, referring to FIG. 5, in a pixel 140' according to another embodiment of the present invention, a pixel circuit 142' includes a driving transistor MD, a switching transistor MS, fourth to seventh transistors M4', M5', M6, and M7, and first and second capacitors C1 and C2.

In the pixel circuit 142', a gate electrode of the fourth transistor M4' and a gate electrode of the fifth transistor M5' are coupled to a fourth scan line Sn−1 and the seventh transistor M7 and the second capacitor C2 are further included in the pixel circuit 142'.

Here, the fourth scan line Sn−1 receives a previous scan signal (a fourth scan signal) that precedes the first scan signal supplied to the first scan line Sn as the current scan line in a row where the corresponding pixel 140' is selected during the first horizontal period 1HP'. That is, the fourth transistor M4' diode couples the driving transistor MD in response to the fourth scan signal that precedes the first scan signal by the first horizontal period width 1H' and the fifth transistor M5' couples the fourth node N4 to the third power source Vsus in response to the fourth scan signal.

The seventh transistor M7 is coupled between a fourth power source Vint and the first node N1. A gate electrode of the seventh transistor M7 is coupled to a fifth scan line Sn−2. The fifth scan line Sn−2 receives a fifth scan signal that precedes the fourth scan signal supplied to the fourth scan line Sn−1 by the first horizontal period width 1H'. That is, the fifth scan signal, the fourth scan signal, and the first scan signal are sequentially shifted by the first horizontal period width 1H" in the order of the fifth scan signal, the fourth scan signal, and the first scan signal.

The seventh transistor M7 is turned on when the fifth scan signal is supplied from the fifth scan line Sn−2 to couple the first node N1 to the fourth power source Vint. The fourth power source Vint is an initialization power source set to have a lower voltage than a voltage of a data signal VIdata having a lowest voltage. For example, the data signal may correspond to a highest gray level of a corresponding gray scale. Then, when the driving transistor MD is diode-coupled by the fourth transistor M4, this sets a coupling direction of the diode to be a forward direction regardless of the voltage of the data signal supplied to a previous frame, so that the data signal Vdata may be smoothly stored in the pixel 140'.

The second capacitor C2 is coupled between the first node N1 and the first power source ELVDD to prevent the voltage of the first node N1 from being rapidly changed and to stabilize the operation of the pixel 140'. The second capacitor C2 may be applied to the pixel 140 of FIG. 3 in the same way.

In addition, in a compensation circuit 144' according to the current embodiment, a gate electrode of a first transistor M1' is coupled to the first scan line Sn, a gate electrode of a second transistor M2' is coupled to a fourth emission control line En+2, and a gate electrode of a third transistor M3' is coupled to a fifth emission control line En+3. Here, the fourth emission control line En+2 and the fifth emission control line En+3 respectively receive a fourth emission control signal and a fifth emission control signal shifted by a second horizontal period width 2H' (for example, the second horizontal period width 2H" has twice the value of the first horizontal period width 1H') and a third horizontal period width 3H" (for example, the third horizontal period width 3H' has three times the value of the first horizontal period width 1H') in comparison with the second emission control signal supplied from the second emission control line En.

That is, the first transistor M1' couples the anode electrode of the OLED to the second node N2 in response to the first scan signal. The second transistor M2' couples the second node N2 to the third power source Vsus in response to the fourth emission control signal. The third transistor M3' couples the third node N3 to the third power source Vsus in response to the fifth emission control signal.

Figure 6:
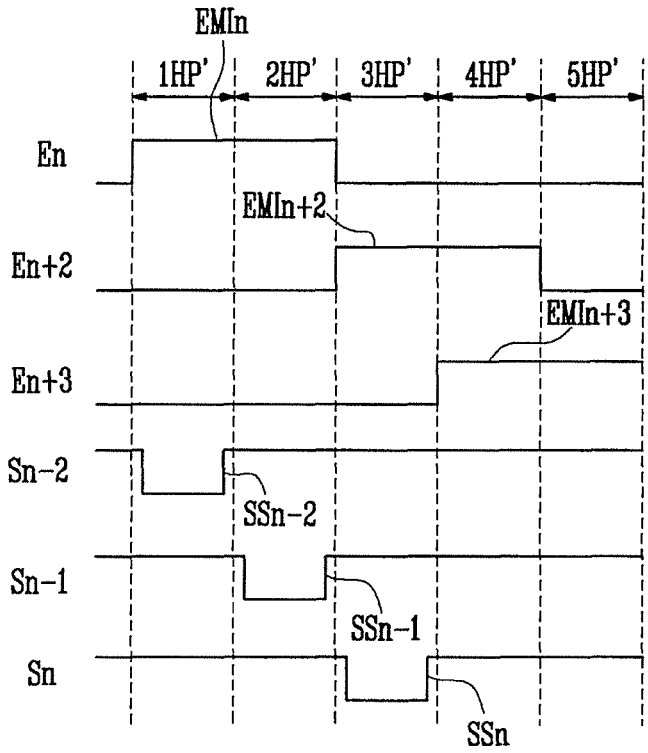
FIG. 6 is a waveform diagram illustrating a method of driving the pixel of FIG. 5.

FIG. 6 is a waveform diagram illustrating a method of driving the pixel of FIG. 5.

Referring to FIG. 6, fifth, fourth, and first scan signals SSn−2, SSn−1, and SSn are sequentially supplied in first to third horizontal periods 1HP' to 3HP'. The second emission control signal EMIn is supplied in the first and second horizontal periods 1HP' and 2HP' to overlap the fifth and fourth scan signals SSn−2 and SSn−1 while having the width corresponding to the second horizontal period width 2H'. The fourth emission control signal EMIn+2 and the fifth emission control signal EMIn+3 are supplied so that the second emission control signal EMIn+2 is shifted by the second horizontal period width 2H' and the third horizontal period width 3H', respectively.

Hereinafter, the operation processes of the pixel 140' illustrated in FIG. 5 will be described in detail with reference to FIG. 6 in combination with FIG. 5.

First, when the fifth scan signal SSn−2 is supplied to the fifth scan line Sn−2 in the first horizontal period 1HP', the seventh transistor M7 is turned on. Therefore, the first node N1 is initialized as the voltage of the fourth power source Vint. The fourth and fifth emission control signals EMIn+2 and EMIn+3 from the fourth and fifth emission control lines En+2 and En+3 maintain a low level in the first horizontal period 1 HP'. Therefore, the second and third transistors M2' and M3' are turned on so that the second and third nodes N2 and N3 maintain the voltage of the third power source Vsus.

When the fourth scan signal SSn−1 is supplied to the fourth scan line Sn−1 in the second horizontal period 2HP' that follows the first horizontal period 1 HP', the fourth and fifth transistors M4' and M5' are turned on. When the fourth transistor M4' is turned on, the driving transistor MD is diode coupled. Therefore, the voltage ELVDD−|Vth| corresponding to the difference between the voltage of the first power source ELVDD and the threshold voltage Vth of the driving transistor MD is applied to the first node N1.

When the fifth transistor M5' is turned on, the voltage Vsus of the third power source Vsus is applied to the fourth node N4. Then, the voltage corresponding to the difference between the voltage of the first node N1 and the voltage of the fourth node N4, that is, ELVDD−|Vth|−Vsus is stored in the first capacitor C1.

The fourth and fifth emission control signals EMIn+2 and EMIn+3 from the fourth and fifth emission control lines En+2 and En+3 maintain a low level in the second horizontal period 2HP'. Therefore, the second and third nodes N2 and N3 maintain the voltage of the third power source Vsus.

When the first scan signal SSn is supplied to the first scan line Sn in the third horizontal period 3HP' that follows the second horizontal period 2HP', the switching transistor MS and the first transistor M1' are turned on. When the switching transistor MS is turned on, the voltage of the data signal Vdata is applied to the fourth node N4 so that the voltage of the fourth node N4 is changed from the voltage Vsus of the third power source Vsus into the voltage Vdata of the data signal. At this time, since the first node N1 is floated, the voltage of the first node N1 is changed by j'(Vsus-Vdata) corresponding to a difference between the voltage Vsus of the third power source and the voltage Vdata of the data signal. Here, j' is a proportionate value corresponding to charge sharing by a capacitance ratio between the first and second capacitors C1 and C2 and the second feedback capacitor Cfb2. Therefore, the voltage of the first node N1 is ELVDD−|Vth|+j'(Vsus−Vdata).

On the other hand, the voltage level of the second emission control signal EMIn supplied from the second emission control line En is reduced to a low level in the third horizontal period 3HP'. Therefore, while the sixth transistor M6 is turned on, a current Ioled' illustrated in the following EQUATION 2 flows through the OLED.

$$Ioled'=k(Vgs-|Vth|)^2=k(ELVDD-(ELVDD-|Vth|+j'(Vsus-V\text{data}))-|Vth|)^2=k(j'(Vsus-V\text{data}))^2 \quad \text{EQUATION 2}$$

In addition, when the first transistor M1' is turned on in the third horizontal period 3HP', a voltage Voled' applied to the OLED is applied to the second node N2 and the third node N3 maintains the voltage Vsus of the third power source Vsus by the third transistor M3'. At this time, the second transistor M2' is turned off by the fourth emission control signal EMIn+2 transitioning to a high level. Therefore, a voltage corresponding to the voltage Voled' applied to the OLED is charged in the first feedback capacitor Cfb1.

When the fifth emission control signal EMIn+3 starts being supplied in a fourth horizontal period 4HP' that follows the third horizontal period 3HP', the third transistor M3' is turned off and the third node N3 is floated. Then, when the voltage level of the fourth emission control signal EMIn+2 transitions to a low level in a fifth horizontal period 5HP' that follows the fourth horizontal period 4HP', the second transistor M2' is turned on and the voltage of the second node N2 increases from the voltage Voled' of the OLED to the voltage Vsus of the third power source Vsus.

At this time, since the third node N3 is floated, the voltage of the third node N3 increases to correspond to the voltage increase of the second node N2. Since the first node N1 is floated, the voltage of the first node N1 increases to a predetermined degree to correspond to the voltage increase of the third node N3.

That is, in the fifth horizontal period 5HP', the voltage of the first node N1 is controlled to correspond to the voltage increase of the second node N2 and the driving transistor MD supplies the driving current corresponding to the changed voltage of the first node N1 to the OLED. On the other hand, after the fifth emission control signal EMIn+3 stops being supplied, since the voltage change amount of the third node N3 is not large, the driving current does not significantly change but is almost uniformly maintained.

Therefore, the pixel 140' according to another embodiment of the present invention controls the voltage of the gate electrode of the driving transistor MD to correspond to the deterioration of the OLED so that the deterioration of the OLED is compensated for and that a substantially uniform driving current may be supplied to the OLED regardless of the threshold voltage variation of the driving transistor MD and the voltage reduction variation of the first power source ELVDD.

In addition, in the case of the pixel 140' according to the current embodiment, the fourth node N4 is charged by the voltage of the third power source Vsus before supplying the data signal to the fourth node N4. Therefore, the supply timing of the first scan signal SSn may overlap the demultiplexer timing (a period where data signals are supplied to red (R), green (G), and blue (B) pixels by red, green, and blue control signals CLR, CLG, and CLB) and black brightness may be improved.

While aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED) coupled between a first power source and a second power source;

a pixel circuit comprising a driving transistor coupled between the first power source and the OLED and having a gate electrode electrically coupled to a first node so that driving current corresponding to a driving voltage applied to the first node is supplied to the OLED; and a compensation circuit for controlling the driving voltage applied to the first node in accordance with deterioration of the OLED to compensate for the deterioration of the OLED, wherein the compensation circuit comprises:

first and second transistors coupled between the OLED and a third power source;

first and second feedback capacitors coupled between the first node and a second node that is between the first transistor and the second transistor; and a third transistor coupled between the third power source and a third node that is between the first feedback capacitor and the second feedback capacitor, and wherein the pixel circuit further comprises:

a first capacitor having a first terminal coupled to the first node and a second terminal coupled to a fourth node configured to receive a data voltage, the first capacitor being configured to receive the data voltage from the fourth node at the second terminal and to apply the driving voltage to the first node from the first terminal; and a switching transistor coupled between the fourth node and a data line.

2. The pixel as claimed in claim 1, wherein the pixel circuit further comprises:

a fourth transistor coupled between the gate electrode of the driving transistor and a drain electrode of the driving transistor;

a fifth transistor coupled between the fourth node and the third power source; and a sixth transistor coupled between the driving transistor and the OLED.

3. The pixel as claimed in claim 2, wherein the pixel circuit is coupled between the first node and the first power source.

4. The pixel as claimed in claim 2, wherein a gate electrode of the switching transistor and a gate electrode of the fourth transistor are coupled to a first scan line to receive a first scan signal from the first scan line, wherein a gate electrode of the fifth transistor is coupled to a first emission control line to receive a first emission control signal from the first emission control line, and wherein a gate electrode of the sixth transistor is coupled to a second emission control line to receive a second emission control signal from the second emission control line.

5. The pixel as claimed in claim 4, wherein the first emission control signal and the second emission control signal are voltages of a first voltage level that turn off the fifth and sixth transistors and that are sequentially shifted by a first horizontal period width, and wherein the first scan signal is supplied as a voltage of a second voltage level that is lower than the first voltage level and that turns on the switching transistor and the fourth transistor while the first emission control signal maintains the first voltage level so that the first scan signal starts before the second emission control signal transitions to the first voltage level and stops after the second emission control signal transitions to the first voltage level.

6. The pixel as claimed in claim 5, wherein the first and second emission control signals maintain the first voltage level for a second horizontal period width, and wherein the first scan signal maintains the second voltage level for a part of the first horizontal period width.

7. The pixel as claimed in claim 6, wherein a gate electrode of the first transistor is coupled to a second scan line to receive a second scan signal from the second scan line that is shifted from the first scan signal by the second horizontal period width, wherein a gate electrode of the second transistor is coupled to a third emission control line to receive a third emission control signal that is a voltage of the first voltage level from the third emission control line and that is shifted from the second emission control signal by the first horizontal period width, and wherein a gate electrode of the third transistor is coupled to a third scan line to receive a third scan signal that is a voltage of the second voltage level, that transitions to the second voltage level to turn on the third transistor before the third emission control signal transitions to the first voltage level, and transitions to the first voltage level after the second scan signal is supplied from the second scan line.

8. The pixel as claimed in claim 2, wherein the pixel circuit further comprises a seventh transistor coupled between the first node and a fourth power source.

9. A pixel comprising:

an organic light emitting diode (OLED) coupled between a first power source and a second power source;

a pixel circuit comprising a driving transistor coupled between the first power source and the OLED and having a gate electrode coupled to a first node so that driving current corresponding to a voltage applied to the first node is supplied to the OLED; and a compensation circuit for controlling the voltage of the first node in accordance with deterioration of the OLED to compensate for the deterioration of the OLED, wherein the compensation circuit comprises:

first and second transistors coupled between the OLED and a third power source;

first and second feedback capacitors coupled between the first node and a second node that is between the first transistor and the second transistor; and a third transistor coupled between the third power source and a third node that is between the first feedback capacitor and the second feedback capacitor, and wherein the pixel circuit further comprises:

a first capacitor having one terminal coupled to the first node and an other terminal coupled to a fourth node configured to receive a data voltage;

a switching transistor coupled between the fourth node and a data line;

a fourth transistor coupled between the gate electrode of the driving transistor and a drain electrode of the driving transistor;

a fifth transistor coupled between the fourth node and the third power source;

a sixth transistor coupled between the driving transistor and the OLED; and a seventh transistor coupled between the first node and a fourth power source, wherein a gate electrode of the switching transistor is coupled to a first scan line to receive a first scan signal from the first scan line, wherein a gate electrode of the fourth transistor and a gate electrode of the fifth transistor are coupled to a fourth scan line to receive a fourth scan signal from the fourth scan line, and wherein a gate electrode of the sixth transistor and a gate electrode of the seventh transistor are coupled to a second emission control line and a fifth scan line to receive a second emission control signal and a fifth scan signal from the second emission control line and the fifth scan line.

10. The pixel as claimed in claim 9, wherein the fifth, fourth, and first scan signals are sequentially shifted by a first horizontal period width, and wherein the second emission control signal overlaps the fifth and fourth scan signals.

11. The pixel as claimed in claim 10, wherein a gate electrode of the first transistor is coupled to the first scan line to receive the first scan signal from the first scan line, wherein a gate electrode of the second transistor is coupled to a fourth emission control line to receive a fourth emission control signal from the fourth emission control line that is shifted from the second emission control signal by a second horizontal period width, and wherein a gate electrode of the third transistor is coupled to a fifth emission control line to receive a fifth emission control signal from the fifth emission control line that is shifted from the second emission control signal by a third horizontal period width.

12. The pixel as claimed in claim 11, wherein the fifth, fourth, and first scan signals are voltages of a second voltage level that turn on transistors, and wherein the second, fourth, and fifth emission control signals are voltages of a first voltage level that is higher than the second voltage level and that turn off transistors.

13. The pixel as claimed in claim 8, wherein the fourth power source is set as an initialization power source.

14. The pixel as claimed in claim 1, wherein the first power source and the second power source are set as a high potential pixel power source and a low potential pixel power source to form a current path in a period where the driving current is supplied to the OLED, and wherein the third power source is set as a constant voltage source that does not form a current path.

15. The pixel as claimed in claim 14, wherein the voltage of the third power source has a value between a voltage of the first power source and a voltage of the second power source.

16. An organic light emitting display comprising a display unit comprising a plurality of pixels located at crossing regions of scan lines, emission control lines, and data lines, wherein each of the pixels comprises:

an organic light emitting diode (OLED) coupled between a first power source and a second power source;

a pixel circuit comprising a driving transistor coupled between the first power source and the OLED and having a gate electrode electrically coupled to a first node so that driving current corresponding to a driving voltage applied to the first node is supplied to the OLED; and a compensation circuit for controlling the driving voltage applied to the first node in accordance with deterioration of the OLED to compensate for the deterioration of the OLED, wherein the compensation circuit comprises:

first and second transistors coupled between the OLED and a third power source;

first and second feedback capacitors coupled between the first node and a second node that is between the first transistor and the second transistor; and a third transistor coupled between the third power source and a third node that is between the first feedback capacitor and the second feedback capacitor, and wherein the pixel circuit further comprises:

a first capacitor having a first terminal coupled to the first node and a second terminal coupled to a fourth node configured to receive a data voltage, the first capacitor being configured to receive the data voltage from the fourth node at the second terminal and to apply the driving voltage to the first node from the first terminal; and a switching transistor coupled between the fourth node and one of the data lines, and having a gate electrode coupled to a first scan line of the scan lines to receive a first scan signal.

17. The organic light emitting display as claimed in claim 16, wherein the pixel circuit further comprises:

a fourth transistor coupled between the gate electrode of the driving transistor and a drain electrode of the driving transistor and having a gate electrode coupled to the first scan line;

a fifth transistor coupled between the fourth node and the third power source and having a gate electrode coupled to a first emission control line to receive a first emission control signal; and a sixth transistor coupled between the driving transistor and the OLED and having a gate electrode coupled to a second emission control line to receive a second emission control signal.

18. The organic light emitting display as claimed in claim 17, wherein a gate electrode of the first transistor is coupled to a second scan line to receive a second scan signal, wherein a gate electrode of the second transistor is coupled to a third emission control line to receive a third emission control signal, and wherein a gate electrode of the third transistor is coupled to a third scan line to receive a third scan signal.

19. The organic light emitting display as claimed in claim 18, wherein the first to third emission control signals are voltages of a first voltage level sequentially shifted by a first horizontal period width, wherein the first scan signal is supplied as a voltage of a second voltage level that is lower than the first voltage level while the first emission control signal maintains the first voltage level so that the first scan signal starts before the second emission control signal transitions to the first voltage level and stops after the second emission control signal transitions to the second voltage level, wherein the second scan signal is shifted from the first scan signal by a second horizontal period width, and wherein the third scan signal is a voltage of the second voltage level that transitions to the second voltage level before the third emission control signal transitions to the first voltage level, and transitions to the first voltage level after the second scan signal is supplied.

20. The organic light emitting display as claimed in claim 16, wherein the pixel circuit further comprises:

a fourth transistor coupled between the gate electrode of the driving transistor and a drain electrode of the driving transistor and having a gate electrode coupled to a fourth scan line to receive a fourth scan signal;

a fifth transistor coupled between the fourth node and the third power source and having a gate electrode coupled to the fourth scan line;

a sixth transistor coupled between the driving transistor and the OLED and having a gate electrode coupled to a second emission control line to receive a second emission control signal; and a seventh transistor coupled between the first node and a fourth power source and having a gate electrode coupled to a fifth scan line to receive a fifth scan signal.

21. The organic light emitting display as claimed in claim 20, wherein a gate electrode of the first transistor is coupled to the first scan line, wherein a gate electrode of the second transistor is coupled to a fourth emission control line to receive a fourth emission control signal, and wherein a gate electrode of the third transistor is coupled to a fifth emission control line to receive a fifth emission control signal.

22. The organic light emitting display as claimed in claim 21, wherein the fifth, fourth, and first scan signals are sequentially shifted by a first horizontal period width, wherein the second emission control signal overlaps the fifth and fourth scan signals, and wherein the fourth and fifth emission control signals are shifted from the second emission control signal by a second horizontal period width and a third horizontal period width.

* * * * *